US012195250B2

(12) United States Patent
Charnay et al.

(10) Patent No.: US 12,195,250 B2
(45) Date of Patent: Jan. 14, 2025

(54) PACKAGING DEVICE HAVING A CLOSURE CAP THAT IS PRE-POSITIONABLE ON A CONTAINER NECK

(71) Applicant: L'OREAL, Paris (FR)

(72) Inventors: Patrick Charnay, Clichy (FR); Julien Hameau, Clichy (FR); Jean-Marie Hervet, Clichy (FR)

(73) Assignee: L'OREAL, Paris (FR)

( * ) Notice: Subject to any disclaimer, the term of this patent is extended or adjusted under 35 U.S.C. 154(b) by 101 days.

(21) Appl. No.: 17/911,822

(22) PCT Filed: Mar. 16, 2021

(86) PCT No.: PCT/EP2021/056697

§ 371 (c)(1),
(2) Date: Sep. 15, 2022

(87) PCT Pub. No.: WO2021/185843

PCT Pub. Date: Sep. 23, 2021

(65) Prior Publication Data

US 2023/0032274 A1 Feb. 2, 2023

(30) Foreign Application Priority Data

Mar. 16, 2020 (FR) ..... 2002558

(51) Int. Cl.
*B65D 51/22* (2006.01)

(52) U.S. Cl.
CPC .... *B65D 51/225* (2013.01); *B65D 2251/0015* (2013.01); *B65D 2251/0093* (2013.01)

(58) Field of Classification Search
CPC ..... B65D 51/225; B65D 2251/0015; B65D 2251/0093; B65D 51/222
See application file for complete search history.

(56) References Cited

U.S. PATENT DOCUMENTS 3,977,557 A 6/1976 Hazard
4,289,248 A * 9/1981 Lynn ..... B65D 41/0471 215/331

(Continued)

FOREIGN PATENT DOCUMENTS

EP 3235754 A1 10/2017
FR 2318795 A1 2/1977

(Continued)

OTHER PUBLICATIONS

International Search Report (ISR) for PCT/EP2021/056697 mailed Jun. 10, 2021 (4 pages).

(Continued)

*Primary Examiner* — James N Smalley

(74) *Attorney, Agent, or Firm* — Shumaker, Loop & Kendrick, LLP

(57) ABSTRACT

Device including a cap having a skirt provided with at least one thread element and with at least one relief that is separate from the thread element. A container provided with a neck having at least one screw thread in which the thread element can engage, at least one housing, the relief on the cap being configured to snap-fit in the housing at the end of a movement for pre-positioning the cap on the neck. The preferably has at least one ramp having an opposite slope and at least one space for receiving the thread element in the pre-positioned position, situated between a passage for introducing the thread element into the screw thread and an upright at least partially delimiting said housing.

18 Claims, 8 Drawing Sheets

(56) References Cited

U.S. PATENT DOCUMENTS

| | | | | |
|---|---|---|---|---|
| 5,123,556 | A | 6/1992 | Goldenberg | |
| 5,634,566 | A * | 6/1997 | Jansen | B65F 1/1615 220/254.1 |
| 10,730,669 | B2 * | 8/2020 | Cesare | B65D 41/34 |
| 2017/0297788 | A1 * | 10/2017 | Defert | B65D 41/02 |
| 2022/0234799 | A1 * | 7/2022 | Defert | B65D 41/34 |

FOREIGN PATENT DOCUMENTS

| | | | |
|---|---|---|---|
| FR | 3050187 | A1 | 10/2017 |
| LU | 88845 | A1 | 6/1998 |
| WO | 2017/162560 | A1 | 9/2017 |

OTHER PUBLICATIONS

Written Opinion (WO) for PCT/EP2021/056697 mailed Jun. 10, 2021 (7 pages).

* cited by examiner

PACKAGING DEVICE HAVING A CLOSURE CAP THAT IS PRE-POSITIONABLE ON A CONTAINER NECK

TECHNICAL FIELD

The present invention relates to packaging devices, and more particularly those having a closure cap mounted on a container neck.

BACKGROUND

Certain packaging devices have a neck closed off by a membrane seal that has to be cut by the closure cap during use. In this case, the cap has to be able to be mounted on the neck in a standby position in which it does not affect the membrane seal.

The patent LU 88845 describes a packaging device of this type, having means for premounting the cap on the neck in a standby position. The cap has a tubular skirt provided with thread elements that are accommodated in corresponding receiving spaces in the neck, prior to the final screwing of the cap onto the neck. An interior hollow shaft extends coaxially with the tubular skirt in order to cut the membrane seal. The neck has a screw thread that is delimited at the top by a helical rib, the upper surface of which defines a ramp that guides the thread element towards its receiving space during the pre-mounting of the cap. The thread element is then immobilized between a stop that is present under the lower end of the ramp and a step formed at the upper end of the following ramp.

Such a device has to allow both easy and reliable pre-positioning of the cap during its automated mounting, effective retention in this position during packaging and transport operations, and easy opening on the part of the user.

The application EP 3 235 754 discloses a packaging device configured to keep the cap in a standby position prior to perforation of the membrane seal, just like the patent LU 88845. The neck is provided with a ring approximately halfway up, which is positioned between reliefs on the cap at the end of a first screwing travel of the cap. In variants, the cap is made with reliefs that engage in corresponding tracks made on the neck, which have been given a particular shape so as to define a standby position. These tracks are upwardly open in order to allow the engagement of the reliefs on the cap.

SUMMARY

It may prove advantageous to mark the stopping of the cap in the premounting position in a more pronounced manner, in order to take account of the manufacturing and operating tolerances of the machines used to this end, and to increase the force that would be necessary to remove the cap once it has been pre-positioned. However, any measures taken to this end must not make the equipment used for automated mounting overly complicated, or make the cap or the neck more difficult to mould, or be to the detriment of the ease of use and in particular the force necessary for screwing the cap on fully and the sensation felt by the user during this operation.

There is a need to further improve a device of the type described in the patent LU 88845, in order in particular to increase the reliability of the automatic mounting of the cap on the neck in the pre-positioned position and to ensure that it is held effectively in this position prior to use.

The invention aims to meet this need and the subject thereof, according to a first of its aspects, is a packaging device having:

- a closure cap having a tubular skirt provided on its inner surface with at least one thread element and with at least one relief that protrudes towards the interior of the cap and is separate from the thread element(s),
- a container provided with a neck on which the closure cap is mounted, this neck having:
  - at least one screw thread in which the thread element can engage in order to allow the cap to be screwed onto the neck,
  - at least one housing, the relief on the cap being configured to snap-fit in the housing at the end of a movement for pre-positioning the cap on the neck.

When the cap is pre-positioned at the end of this pre-positioning movement, it is not in its normal use position, and has to be screwed on further in order to reach this position. The housing preferably has a closed contour.

Preferably, the subject of the invention is a packaging device which has:

- a closure cap having a tubular skirt provided on its inner surface with at least one thread element and with at least one relief that protrudes towards the interior of the cap and is separate from a thread element,
- a container provided with a neck on which the closure cap is mounted, this neck extending along an axis as far as an end opening, and having:
  - at least one screw thread in which the thread element can engage in order to allow the cap to be screwed onto the neck,
  - at least one ramp having a slope opposite to that of the screw thread, this ramp being situated closer to the opening in the neck than said screw thread,
  - at least one housing that is further away from the opening in the neck than at least one part of the ramp,
  - at least one space for receiving the thread element in a pre-positioned position of the cap on the neck, this receiving space being situated between a passage for introducing the thread element into the screw thread and an upright at least partially delimiting said housing, the relief on the cap being configured to snap-fit in the housing at the end of a movement for pre-positioning the cap on the neck, at the end of which the thread element is accommodated in said corresponding receiving space.

The invention makes it possible to more clearly mark the stopping of the cap in the pre-positioned position, by virtue of the snap-fitting of the relief on the cap in the housing in the neck. In addition, since a certain force is required to remove the relief from its housing, some users may prefer this more clear-cut movement, for safety reasons.

It is thus possible to more easily eliminate, if desired, a radial and/or axial clearance between the cap and the neck in the pre-positioned position of the cap.

Manufacturing the cap in a factory is not made overly complicated, since the relief can be moulded by taking advantage of the available space on the inner surface of the tubular skirt between the thread elements and can be demoulded by force. In addition, the stopping of the relief in the corresponding housing is reproducible and precise.

The invention also makes it possible to use the space available under the ramp to form the housing for receiving the relief, and to save on material by avoiding making the ramp by moulding a solid protuberance over its entire height.

The ramp can be made, if desired, with a relatively steep slope, thereby reducing the angular travel that the cap has to effect while it is being pre-positioned on the neck. This can make the operation of automatically fitting the cap on the neck easier.

The relief retains the possibility of passing over the upright relatively easily during the screwing on of the cap, such that the user does not need to apply too much effort to carry out this operation. However, the presence of the relief increases the effort that needs to be applied to separate the cap from the neck, and thus the retention of the cap on the neck is enhanced with regard in particular to an incorrect movement on the part of the user attempting to screw the cap on by turning it in the wrong direction.

Preferably, the upright extends axially.

Preferably, the upright extends continuously from the ramp as far as a helical rib that delimits the bottom of the screw thread. This enhances the solidity thereof and makes it possible to retain the relief effectively in the housing.

Preferably, the housing has a contour with a triangular overall shape. Such a shape is advantageous in that it makes it possible to obtain an effect of trapping the relief in the housing in the event of continuation of the rotational movement of the cap in the anticlockwise direction after the snap-fitting of the relief in the housing. The continuation of the rotational movement in the anticlockwise direction is thus prevented effectively once the pre-positioned position has been reached. This makes it possible to apply more torque on fitting the cap without otherwise risking damaging the device.

The relief may be made with various shapes, and, for example, the relief is made with a circular contour. In this case, the diameter at the base of the relief can be chosen such that it can bear only against the two sides of the housing that are opposite the upright, once the latter has been passed over. This ensures clear-cut snap-fitting of the relief in the housing.

The relief may have a frustoconical or dome shape. In a variant, the relief has a contour with substantially the same shape as the housing, in particular a triangular contour.

The abovementioned introduction passage may be at least partially closed off by a stop that can be passed over by the thread element during the screwing on of the cap. This stop may be for example in the form of a radially oriented rib that has a height lower than that of the screw thread of the neck and is connected for example at the bottom to a helical rib of the neck delimiting this screw thread.

Preferably, the ramp has a lower end defining a set-back surface inclined towards the introduction passage. This may generate a snap-fitting effect of the thread element in the corresponding receiving space, which contributes to immobilizing the cap on the neck in its standby position. The ramp may thus have a rounded lower end.

The tubular skirt and the neck may have rotation-prevention means that prevent the cap from being unscrewed at the end of the movement screwing it onto the neck. These rotation-prevention means may have first reliefs made at the base of the neck, which cooperate with second reliefs made on the cap at the end of the screwing on thereof, in order to prevent the reverse movement.

In particular when the neck is made with a membrane seal, the cap may have an interior hollow shaft designed to pass into the neck during the screwing on of the cap, this hollow shaft having at least one tooth for cutting the membrane seal closing the neck, this tooth being positioned above the membrane seal when the cap is in its pre-positioned position.

A further subject of the invention is a method for mounting the cap on the neck of a packaging device according to the invention, as defined above, wherein the cap is fitted on the neck in its pre-positioned position by an axial and anticlockwise rotational movement until the relief snap-fits in the housing.

The operation of fitting in the pre-positioned position is realized automatically. The cap can then be screwed onto the neck in a clockwise direction of rotation, this operation being performed manually by the user.

BRIEF DESCRIPTION OF THE DRAWINGS

The invention may be understood better from reading the following detailed description of nonlimiting implementation examples thereof and from examining the appended drawing, in which.

DETAILED DESCRIPTION

Figure 1:
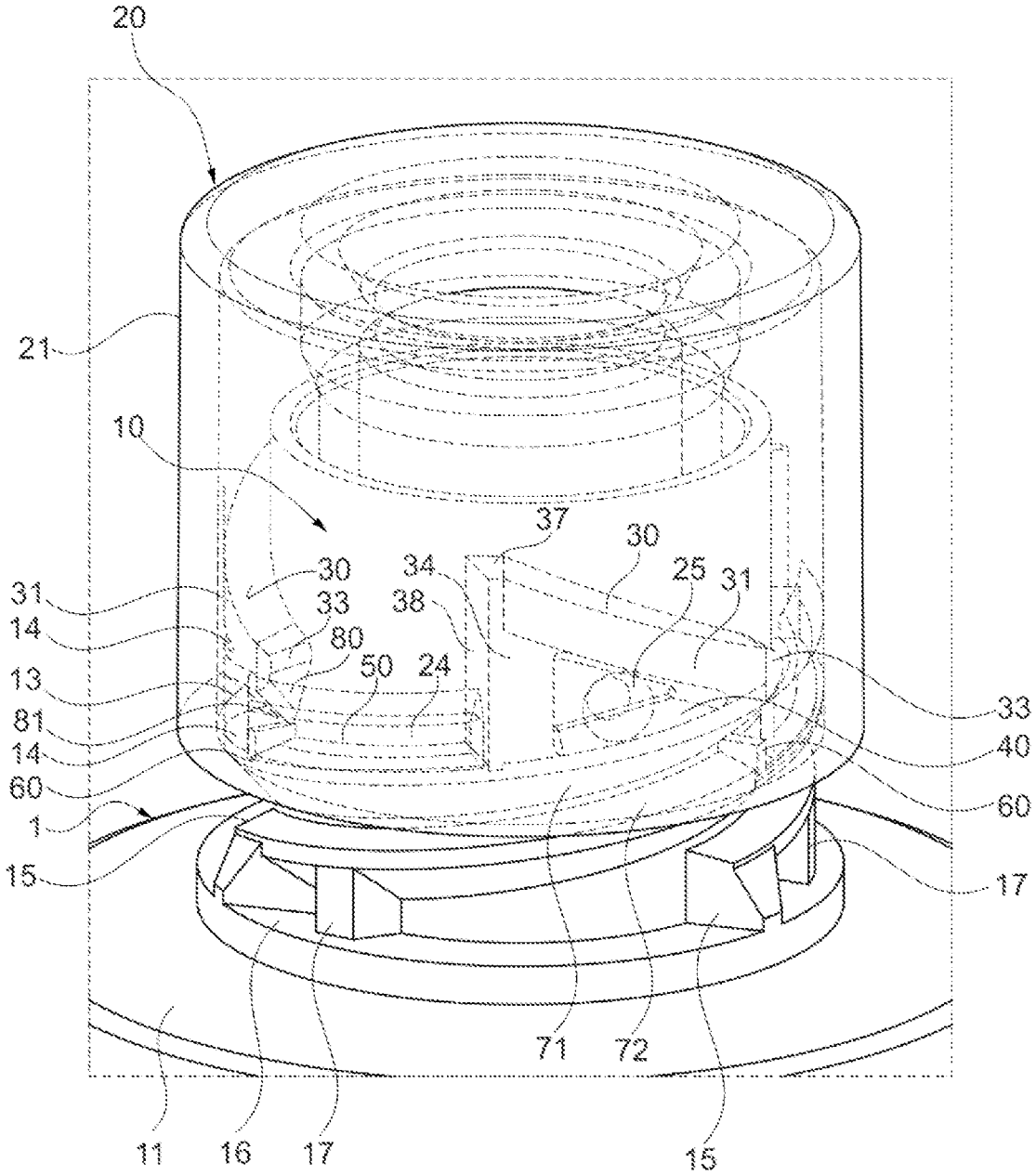
FIG. 1 partially and schematically shows an example of a packaging device according to the invention, the cap being depicted so as to show hidden detail in its pre-positioned position on the neck.

FIG. 1 shows the neck 10 of a container 11, receiving a closure cap 20. The container 11 forms, with the cap 20, a packaging device 1 according to the invention.

The neck 10 and the cap 20 may be produced by moulding plastics material.

Figure 2:
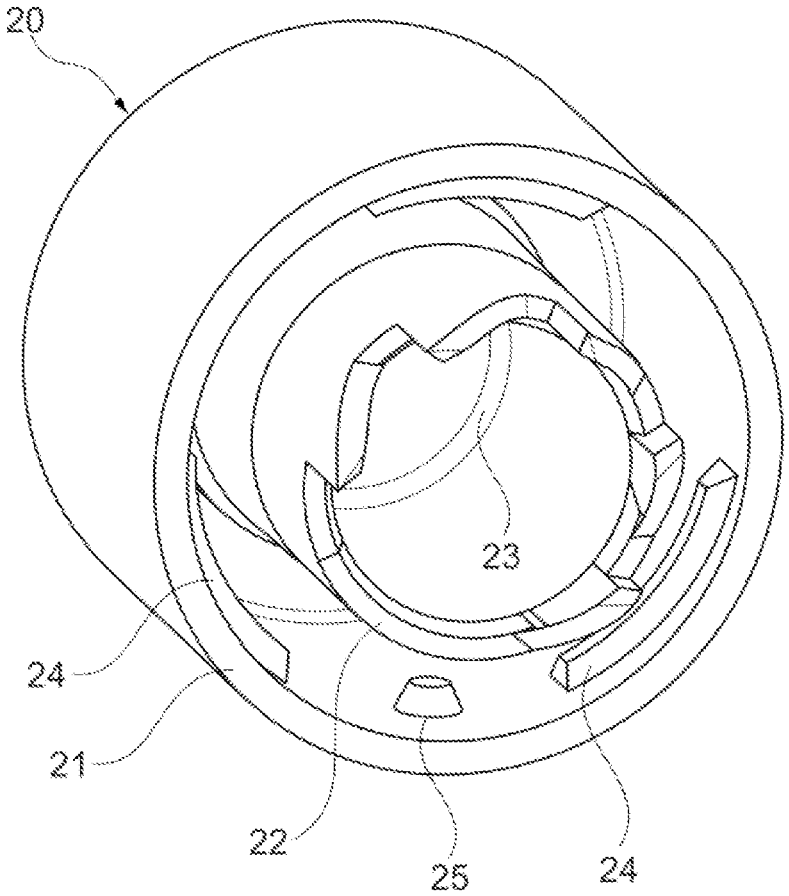
FIG. 2 shows the closure cap from FIG. 1 on its own.

Referring to FIG. 2, it can be seen that the cap 20 is made with an outer tubular skirt 21 and a coaxial inner hollow shaft 22, provided at its end with teeth 23 for cutting a membrane seal for closing off the neck, not visible in the figures.

The cap 20 may be provided, on its side facing away from the container, with any system for opening/closing and for dispensing the product contained in the container, for example a pivoting lid provided with a peg for closing a dispensing orifice, these elements being quite conventional and not being shown in the drawing in order to simplify the description.

Similarly, the cap 20 has any sealing means for ensuring leak tight circulation of the product contained in the container while it is being dispensed, for example a sealing lip that presses in a sealing manner against the inner surface of the neck.

The tubular skirt 21 has on its inner surface thread elements 24, of which there are three, for example, as illustrated, which are distributed at equal angles around the axis of the cap.

At least one relief 25 is also carried by the skin 21, this relief being situated approximately halfway angularly between the adjacent thread elements 24.

In the example in question, the relief 25 has a frustoconical shape, having a thickness, measured in the radial direction, substantially equal to that of the thread elements 24.

Returning to FIG. 1, it can be seen that the neck 10 carries a screw thread 13, which is for example a triple screw thread, as illustrated, delimited by helical ribs 14 that protrude from the neck.

Each rib 14 is interrupted for example at its lower end 15 at a certain distance from the base 16 of the neck. The latter may have, at its base, means such as teeth 17, which cooperate with corresponding, conventional, reliefs on the cap in order to prevent the cap from being unscrewed once it has been fully screwed onto the neck.

Figure 9:
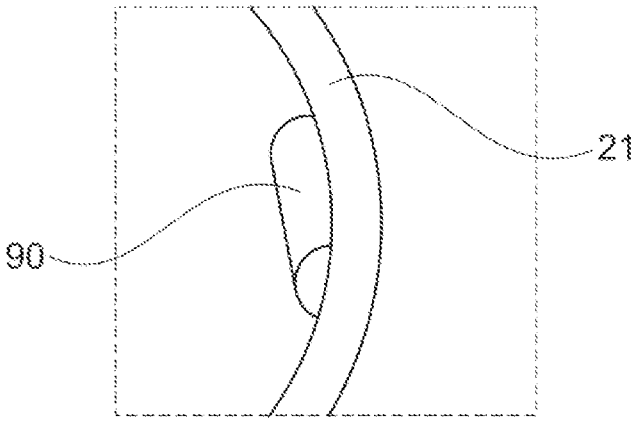

FIG. 9 schematically shows an example of a relief 90 on the cap that is able to pass over a tooth 17 at the end of screwing on but then prevents a reverse unscrewing movement.

The neck 10 carries ramps 30, of which there are three, like the thread elements 24, in the example illustrated.

Each ramp 30 is defined by a helical rib 31 which has an opposite orientation to that of the ribs 14, and a steeper slope.

Each ramp 30 is connected at its bottom to the end of a rib 14 by a rounded portion 33 defining a set-back surface 80 that is inclined towards the introduction passage 81 by which the thread element 24 is engaged in the screw thread 13.

Axially oriented uprights 34 connect the rib 14 to the upper end 37 of the ramp 30.

The ribs 14 and 31 define, with the associated upright, a housing 40 of closed contour, approximately in the form of a right-angled triangle, the hypotenuse of which is defined by the rib 31.

The outer flank 38 of the upright 34 defines, with the lower end of the adjacent ramp 30, a space 50 for receiving a corresponding thread element 24, as illustrated.

Figure 7:
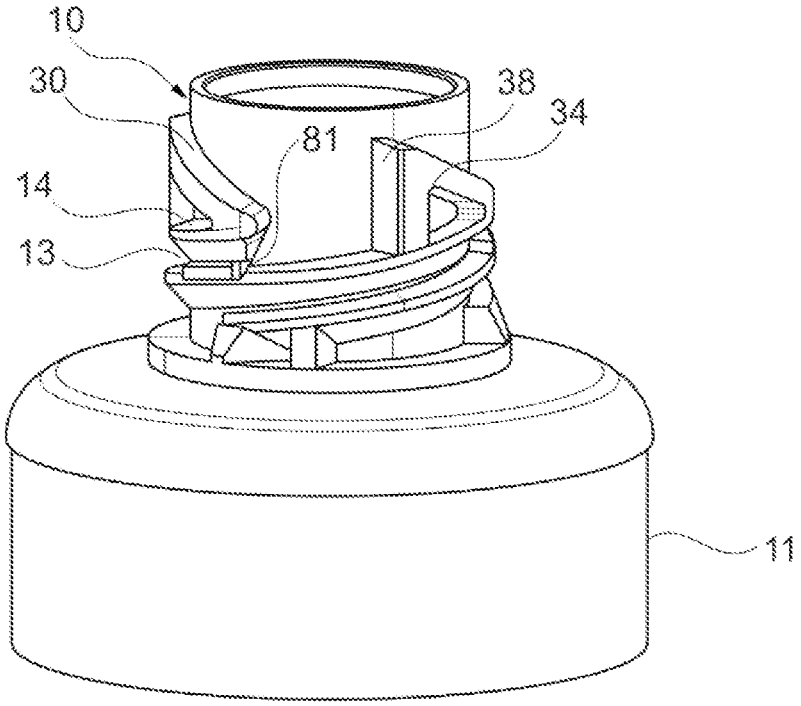
FIG. 7 shows the neck from FIG. 1 on its own.
Figure 8:
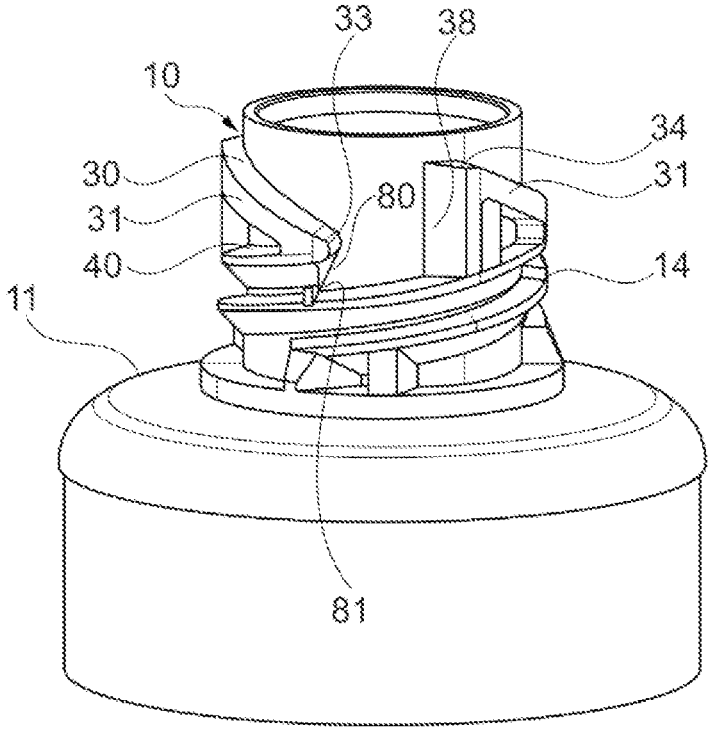
FIG. 8 is a view similar to FIG. 7 of an embodiment variant of the neck, FIG. 9 partially and schematically shows a rotation-prevention relief provided on the cap.

The flank 38 is preferably inclined with respect to the normal, with a slope directed towards the housing 40 away from the cylindrical wall of the neck 10. This slope makes it easier for the relief 25 to pass over the upright 34 during the premounting of the cap on the neck, and is, for example, 45° as illustrated in FIG. 7 or 60° as illustrated in FIG. 8.

A stop 60 is present in each passage 81 for introducing the thread element 24 into the screw thread 13.

The stops 60 are formed by radially oriented ribs which are carried by the rib 14 extending under the rounded end 33 and the height of which is less than the width of the screw thread 13.

The assembly of the cap 20 on the neck 10 may be effected automatically, the neck 10 already being provided with its membrane seal.

The cap 20 is lowered onto the neck 10. During this downward movement, the thread elements 24 bear on the ramps 30 and are guided by the latter towards the spaces 50.

The thread elements 24 pass, by elastic deformation, over the rounded ends 33 and snap-fit in the spaces 50. At the same time, the relief 25 passes, by elastic deformation, over the upright 34 and snap-fits in the housing 40.

In the pre-positioned position of the cap 20, illustrated in FIG. 1, the cap 20 is prevented from rotating by the abutment of the ends of each thread element 24 against the upright 34 and the corresponding stop 60.

If an attempt is made to rotate in the anticlockwise direction, the relief 25 bears against the edges of the housing 40 that are defined by the ribs 31 and 14, thereby providing additional resistance to accidental removal of the cap 20.

When the user wishes to perforate the membrane seal, they turn the cap in the clockwise direction, causing the thread elements 24 to pass over the stops 60. The latter may in particular be crushed as the thread elements 24 pass over, on account of their small thickness and width.

The relief 25 may pass over the upright 34 by local elastic deformation. Next, the width of the relief 25 allows it to move in the screw thread 13.

In the example in question, the shape of the relief 25 is frustoconical and the slope of the cone corresponds advantageously to the opening of the flanks 71 and 72 of the screw thread 13 towards the outside, thereby making it possible to limit the friction of the relief 25 on the screw thread 13 during the rotation of the cap 20. In variants, the flanks 71 and 72 of the screw thread 13 are more or less open towards the outside, compared with the configuration illustrated.

In the standby position of the cap, the teeth 23 are kept away from the membrane seal. While the cap 20 is being fully screwed on, the teeth 23 cut the membrane seal.

Once the cap 20 has been fully screwed onto the neck, it is prevented from being unscrewed by virtue of the rotation-prevention means.

Numerous modifications can be made to the device that has just been described, without departing from the scope of the present invention.

For example, the shape of the relief 25 may be modified.

Figure 3:
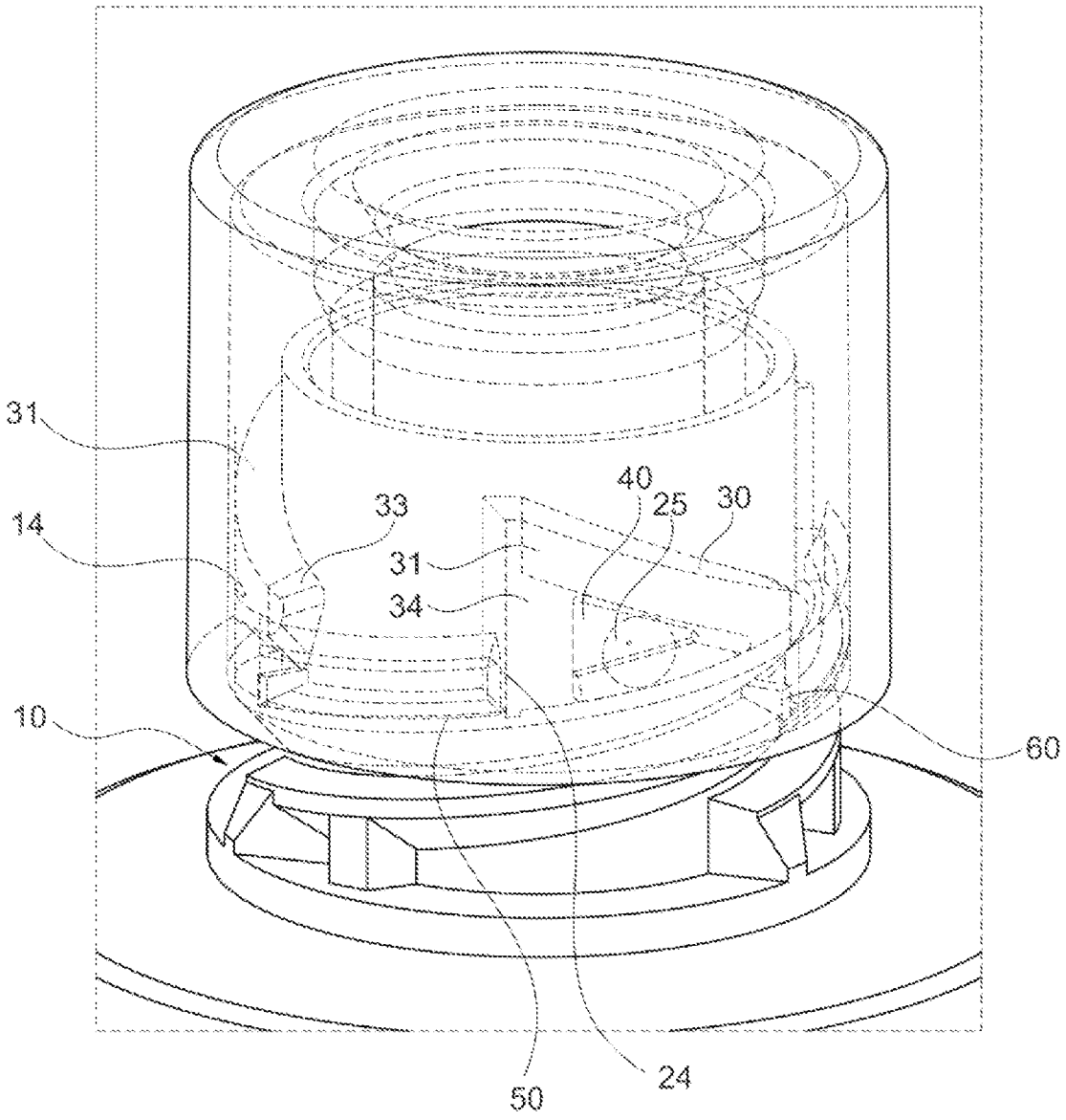
FIG. 3 is a view similar to FIG. 1 of an embodiment variant.
Figure 4:
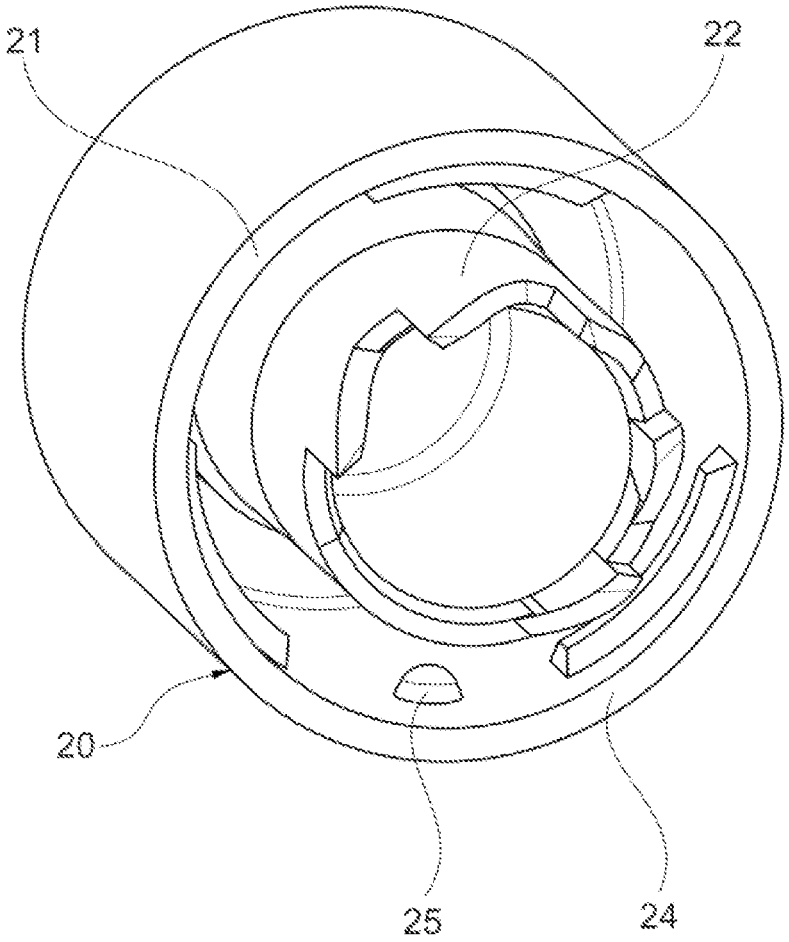
FIG. 4 shows the closure cap from FIG. 3 on its own.
Figure 5:
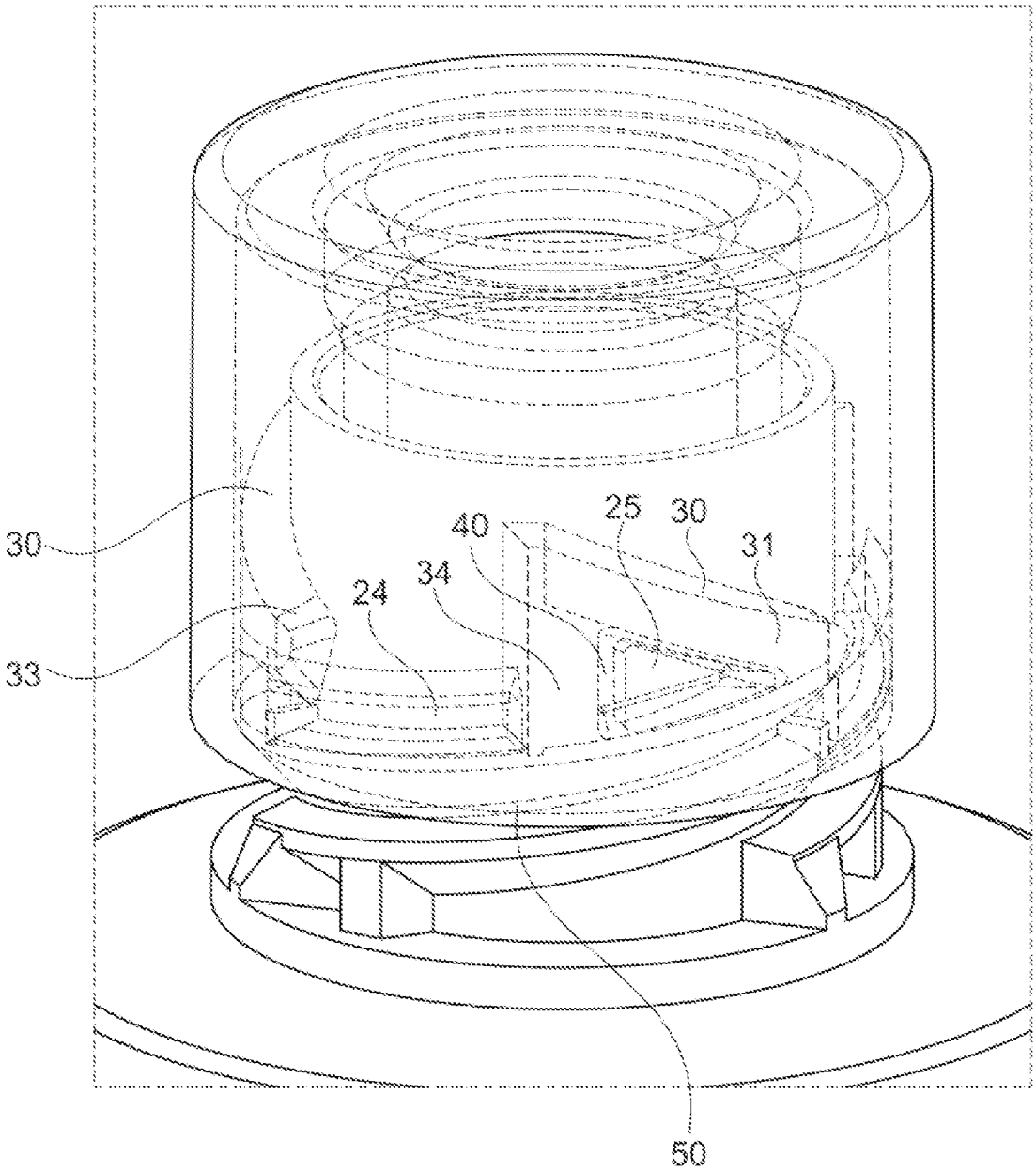
FIG. 5 is a view similar to FIG. 1 of another embodiment variant.
Figure 6:
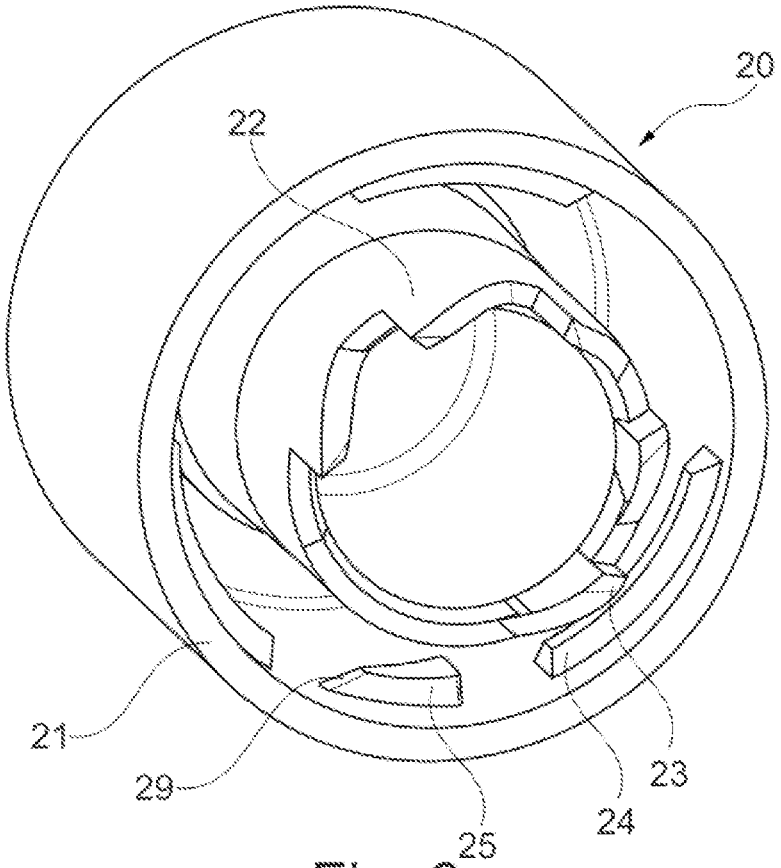
FIG. 6 shows the closure cap from FIG. 5 on its own.

FIGS. 3 and 4 illustrate an embodiment variant in which the relief 25 has a dome shape, and FIGS. 5 and 6 illustrate a variant in which the relief 25 has a contour with substantially the same shape as the housing 40.

A substantially triangular shape of the relief 25 may increase the extent of the relief surface 25 bearing against the edges of the housing 40 in order to prevent anticlockwise rotation of the cap 20.

It can be seen in FIG. 6 that the relief 25 with a triangular overall shape may have an inclined edge face 29, which makes it easier for the relief 25 to pass over the upright 34 during the mounting of the cap 20. In this example, the width of the relief 25 remains less than or equal to that of the screw thread 13, so as not to generate too much friction while the cap is being fully screwed on.

In variants that are not illustrated, the upright 34 is given some other shape, for example a circular arc shape or an interrupted shape.

The stops 60 may be dispensed with, if necessary, if the retention force provided by the engagement of the relief 25 in the housing 40 is sufficient.

The number of reliefs 25 may be multiplied and in particular as many reliefs 25 as housings 40 may be provided.

The number of screw threads 24 may be other than three, for example equal to 1, 2 or 4.

The housing 40 may have a closed contour, as illustrated, or, in a variant, have an open contour, in particular when the upright 34 is discontinuous.

The invention claimed is:

1. A packaging device having:

a closure cap having a tubular skirt provided on its inner surface with at least one thread element and with at least one relief that protrudes towards the interior of the cap and is separate from the thread element(s), a container provided with a neck on which the closure cap is mounted, this neck having:

at least one screw thread in which the thread element can engage in order to allow the cap to be screwed onto the neck, at least one housing, the relief on the cap being configured to snap-fit in the housing at the end of a movement for pre-positioning the cap on the neck, wherein the cap at the end of the pre-positioning movement is not in its normal use position and has to be screwed on further in order to reach the normal use position, the neck extending along an axis as far as an end opening, the neck having at least one ramp having a slope with an opposite orientation to that of the screw thread, this ramp being situated closer to the opening in the neck than said screw thread, the housing being further away from the opening in the neck than at least one part of the ramp, the neck having at least one space for receiving the thread element in a pre-positioned position of the cap on the neck, the receiving space being situated between a passage for introducing the thread element into the screw thread and an upright at least partially delimiting said housing, the thread element being accommodated in said corresponding receiving space at the end of the pre-positioning movement.

2. The device according to claim 1, wherein the upright extends axially.

3. The device according to claim 2, wherein the upright extends continuously from the ramp as far as a helical rib that delimits the bottom of the screw thread.

4. The device according to claim 1, wherein the housing has a contour with a triangular overall shape.

5. The device according to claim 1, wherein the housing has a closed contour.

6. The device according to claim 1, wherein the relief has a circular contour.

7. The device according to claim 6, wherein the relief has a frustoconical or dome shape.

8. The device according to claim 1, wherein the relief has a contour with substantially the same shape as the housing.

9. The device according to claim 1, wherein the introduction passage is at least partially closed off by a stop that can be passed over by the thread element during the screwing on of the cap.

10. The device according to claim 1, wherein the ramp has a lower end defining a set-back surface, inclined towards the introduction passage.

11. The device according to claim 10, wherein the ramp has a rounded lower end.

12. The device according to claim 1, wherein the tubular skirt and the neck have a rotation-prevention means that prevents the cap from being unscrewed at the end of the movement screwing it onto the neck.

13. The device according to claim 1, wherein the cap has an interior hollow shaft designed to pass into the neck during the screwing on of the cap, this hollow shaft having at least one tooth for cutting a membrane seal closing the neck, this tooth being positioned above the membrane seal when the cap is in its pre-positioned position on the neck.

14. A method for mounting the cap on the neck of a packaging device as defined in claim 1, wherein the cap is fitted on the neck in its pre-positioned position by an axial and anticlockwise rotational movement until the relief snap-fits in the housing.

15. The method according to claim 14, wherein the operation of fitting in the pre-positioned position is realized automatically.

16. The method according to claim 14, wherein, at the time of use, the cap is then screwed onto the neck in a clockwise direction of rotation.

17. A packaging device having:

a closure cap having a tubular skirt provided on its inner surface with thread elements and with at least one relief that protrudes towards the interior of the cap and is separate from said thread elements, a container provided with a neck on which the closure cap is mounted, this neck having:

at least one screw thread in which the thread element can engage in order to allow the cap to be screwed onto the neck, at least one housing, the relief on the cap being configured to snap-fit in the housing at the end of a movement for pre-positioning the cap on the neck, wherein the cap at the end of the pre-positioning movement is not in its normal use position and has to be screwed on further in order to reach the normal use position, the cap having an interior hollow shaft designed to pass into the neck during the screwing on of the cap, this hollow shaft having at least one tooth for cutting a membrane seal closing the neck, this tooth being positioned above the membrane seal when the cap is in its pre-positioned position on the neck.

18. A packaging device having:

a closure cap having a tubular skirt provided on its inner surface with at least one thread element and with at least one relief that protrudes towards the interior of the cap and is separate from the thread element(s), the at least one thread element being helical, a container provided with a neck on which the closure cap is mounted, this neck having:

at least one screw thread in which the thread element can engage in order to allow the cap to be screwed onto the neck, at least one housing, the relief on the cap being configured to snap-fit in the housing at the end of a movement for pre-positioning the cap on the neck, wherein the cap at the end of the pre-positioning movement is not in its normal use position and has to be screwed on further in order to reach the normal use position, the cap having an interior hollow shaft designed to pass into the neck during the screwing on of the cap, this hollow shaft having at least one tooth for cutting a membrane seal closing the neck, this tooth being positioned above the membrane seal when the cap is in its pre-positioned position on the neck, the relief having a shape that is one of a shape with a circular contour, a frustoconical shape and a dome shape.

* * * * *